United States Patent [19]

Minns

[11] 3,945,470

[45] Mar. 23, 1976

[54] POSITIONAL CONTROL

[75] Inventor: George Eric Minns, Middlesex, England

[73] Assignee: Dewhurst & Partner Limited, Middlesex, England

[22] Filed: Mar. 11, 1974

[21] Appl. No.: 449,604

[30] Foreign Application Priority Data

Mar. 16, 1973 United Kingdom ..... 12881/73

[52] U.S. Cl. ..... 187/29 R

[51] Int. Cl.[2] ..... B66B 1/50

[58] Field of Search ..... 187/29

[56] References Cited

UNITED STATES PATENTS

| | | | |
|---|---|---|---|
| 2,805,735 | 9/1957 | Kramer | 187/29 |
| 3,199,630 | 8/1965 | Engel et al. | 187/29 |
| 3,207,265 | 9/1965 | Lund et al. | 187/29 |
| 3,261,427 | 7/1966 | Morris | 187/29 |

*Primary Examiner*—Robert K. Schaefer
*Assistant Examiner*—W. E. Duncanson, Jr.
*Attorney, Agent, or Firm*—Lawrence E. Laubscher

[57] ABSTRACT

Control apparatus having particular application to the control of the deceleration of an elevator or lift car in approach of a stop position, the apparatus including a sense coil mounted on the lift car and a magnetic member mounted on the lift shaft to vary the flux through the sensing coil in a predetermined manner relative to the distance to go to the stop position, the deceleration being controlled in accordance with the voltage induced by the flux in the sense coil. A magnetically operated switch is also provided on the lift car to respond to the magnitude of the flux to provide a stop signal defining the stop position.

12 Claims, 6 Drawing Figures

POSITIONAL CONTROL

BACKGROUND OF THE INVENTION

The invention relates to motion control apparatus for controlling the relative motion of first and second movable members, and is particularly, although not exclusively, applicable to the control of the deceleration of a lift car on approaching a stop position at floor level.

Ideally, a lift car should be controlled to approach a stop position with a constant rate of deceleration so that there is a square law relationship between distance to go and the instantaneous speed of movement. In known control apparatus, the position of the lift car is sensed, by means for example of an electromagnetic position sensing device, and an electrical analogue of the distance to go to the stop position is generated which is used to control the speed of the lift car. However, practical difficulties occur upon approaching zero speed, in that both the actual speed and the analogue signals diminish towards zero, and the process of speed control requires accurate comparisons of small quantities, in order to produce an effective result. The basis of one particular difficulty is that the control of movement of the machinery involves both dynamic and static loads and many of the loads are variables. In accurately positioning a lift, it is necessary to dissipate the kinetic energies of rotating parts and to offset steady forces due to the mechanical load placed within the lift, and the process of deceleration involves not only a reduction of power level but also the realization of significant levels of braking torque. For variable voltage lift systems in particular, where the braking torque arises from the production of reversed current flow in the drive motor during the whole or part of the deceleration programme, it is critically important that the machinery continues to rotate in the required direction and that, in approaching the stop position, the stability of the system response should be assured.

SUMMARY OF THE INVENTION

The control apparatus of the present invention comprises flux responsive means attached to one of the relatively movable members and magnetic means attached to the other of the relatively movable members so that the flux through the flux responsive means is changed thereby on relative movement of the members, and is arranged for response to the rate of change of flux through the flux responsive means to control the relative speed of the members so as to tend to maintain the rate of change of flux at a constant level.

DESCRIPTION OF PREFERRED EMBODIMENT

The preferred embodiment of the invention is illustrated in the accompanying drawings, wherein.

Figure 1:
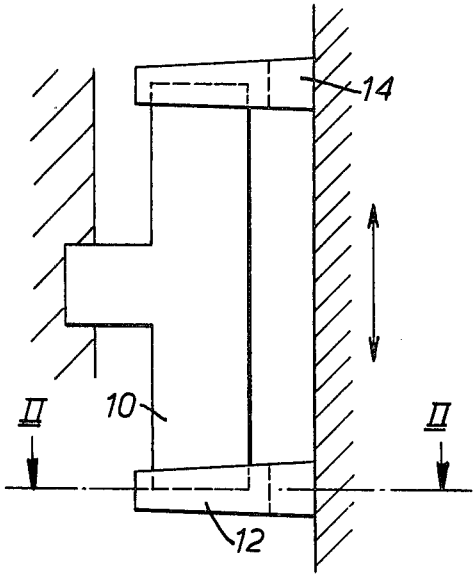
FIG. 1 is a schematic side view of a detector for use in a control apparatus for a lift in accordance with the invention.

The drawings illustrate control apparatus for controlling the approach of a lift car to a stop position, and comprising magnetic flux responsive means, magnetic means for producing a magnetix flux in said flux responsive means whose magnitude is a function of the position of said moving part relative to said stop position, said flux responsive means being responsive to the rate of change of said flux for producing a deceleration signal, and deceleration means responsive to the magnitude of said deceleration signal for causing or permitting deceleration of the speed of approach of the lift car to the stop position. The flux responsive means is also responsive to the magnitude of the flux for producing a two-state stop signal defining the stop position. Conveniently, the flux responsive means includes at least one winding responsive to the rate-of-change of flux, and a reed switch unit responsive to the magnitude of the flux.

The characteristics of the magnetic means and of the flux responsive means can be chosen to suit the desired deceleration pattern. In the apparatus shown in the drawings, the rate of change of the flux sensed by said flux responsive means with the distance of the lift car from the stop position is arranged to increase towards a peak value as the lift car approaches the stop position.

In the preferred embodiment the magnetic means includes means secured relative to said flux responsive means for producing a magnetic field, and a relatively movable member of magnetic material for varying the flux in said flux responsive means. The member of magnetic material is shaped and positioned to provide the desired characteristics; in the preferred embodiment, it presents ends perpendicular to the direction of relative movement, which ends are positioned to cause a peak rate of change of flux with displacement as the lift car approaches the stop position. A respective flux sensor is disposed to respond to the movement of each end as the lift car approaches its stop position, minimizing misalignment errors. The flux sensors are connected in opposition, reducing the effects of stray magnetic fields but increasing the sensitivity and accuracy for the sensed flux.

The deceleration signal is used to effect braking. The braking or deceleration can be produced electromagnetically, for example by controlling the torque of an electric motor serving as prime mover for the lift car. The electromagnetic braking is supplemented by a mechanical friction brake which is applied as the moving part comes substantially to rest at the stop position in response to the two-state stop signal; this gives a particular advantage since the braking effort of the electromagnetic braking system is readily controlled, in this case by controlling the field current of the motor, while the friction brake is better suited to holding the lift car at rest.

Turning now to the drawings in more detail, FIG. 1 shows a detector in the control apparatus, comprising a vane 10 of ferromagnetic material mounted on the lift shaft and two magnetic sensor assemblies 12 and 14, mounted on the lift spaced apart by a distance substantially equal to the length of the vane 10 along the direction of movement of the lift. When the lift is at its stop position at the corresponding floor, the sensor assemblies 12, 14 are positioned adjacent respective ends of the vane 10 as shown in FIG. 1.

Figure 2:
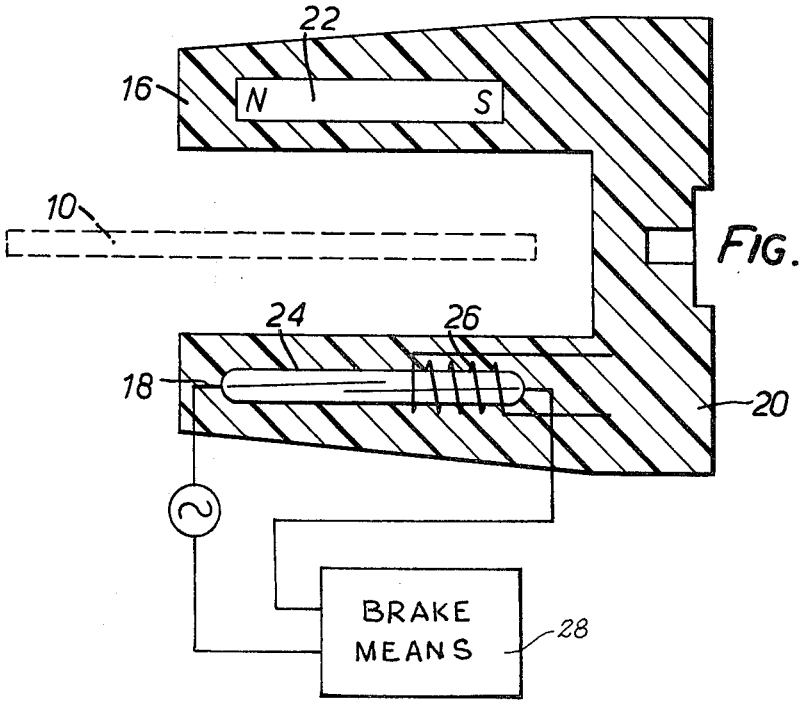
FIG. 2 is a sectional view of a sensor in the detector taken from the line II—II in FIG. 1.

The sensor assemblies are similar. One of them is shown in more detail in FIG. 2. The assembly is generally U-shaped with two arms 16 and 18 and a base 20 moulded in plastics material. The assembly is secured to the lift by the base 20 so that the arms 16 and 18 project from the lift at positions chosen so that the vane 10 may pass between the two arms. A permanent magnet 22 is embedded in the arm 16, and a magnetic sealed contact switch 24 (a so-called reed relay) with a search coil 26 surrounding it are embedded in the arm 18, the axes of the magnet 22, the switch 24 and the coil 26 all being parallel to the lengths of the arms 16 and 18 and to the width of the vane 10. The flux from the magnet 22 normally threads the coil 26 and operates the switch 24. The vane 10 entering between the arms 16 and 18 diverts flux from the coil 26 and from the switch 24 and releases the switch.

Figure 3:
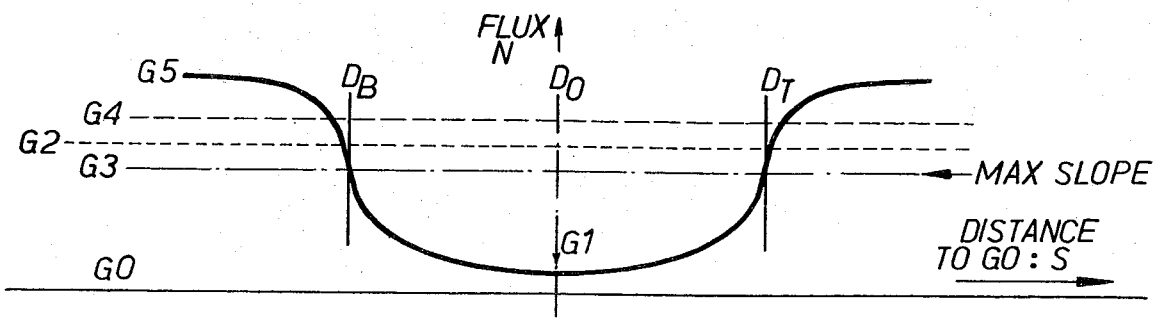
FIG. 3 is a diagram illustrating the variation of a magnetic flux in the sensor as a function of displacement of the lift.

FIG. 3 relates the flux received by one of the detecting devices (vertically) to the position of the device relative to the datum point (horizontally). The flux in the other device is similar but in the opposite sense and the zero of the distance to go is mid-way between the two detecting devices. The various flux levels are as follows: G0 is the zero level, but has no significance in this apparatus, G1 is the minimum flux level and this is experienced when the detecting device is aligned with position DO, which coincides with the centre of the T-shaped vane, G2 represents the notional release point of the switch within the detecting device, G3 represents the level of flux at which occur the maximum slopes of the curve relating flux to position. This level occurs when the detecting device is in positions DT and DB. It is arranged that when one device is at DT, the other is substantially at DB, G4 represents the notional level at which the switch within the detecting devices moves to its operated position, G5 represents the maximum flux level experienced when the T-shaped vane is clear of the detecting device.

Accordingly, each search coil forms a magnetically operated proximity detector operated by the magnetic diverter plate 10 entering between the limbs 16 and 18 on movement to the stop position. The two state signal from the switch marks the stop position and is used to apply the electromechanical brake means 28. The E.M.F. induced in the coil by the varying flux controls the electromagnetic braking. The two proximity switches together produce a basic statement of position of the vane relative to the two switches. In order to exclude the generation of signals within the search coils by extraneous magnetic sources, the two search coils are counter-connected and deployed relative to the diverter plate as described to respond to opposite ends of the diverter vane.

Figure 4A:
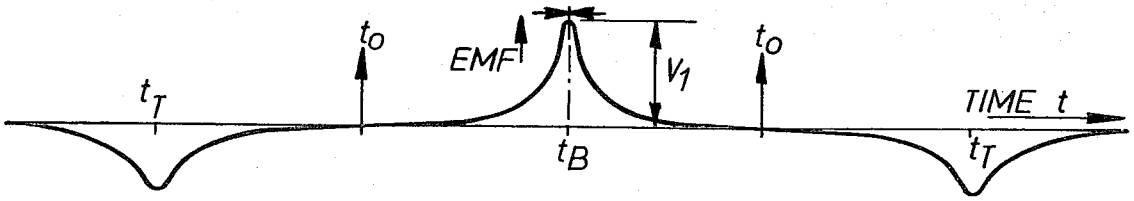
FIGS. 4A to 4B are diagrams illustrating variations with time of an output signal from the detector, for different spacings of two sensors in the detector.

FIG. 4A shows the voltage at the terminals of the two combined search coils, as a function of time, assuming that the diverter plate 10 is being moved through the stationary proximity switches at a steady speed. The negative going excursions at $t_T$ correspond to the passage of the leading edge of the diverter vane 10 through the first proximity detector and the passage of the trailing edge of the diverter vane through the second detector and are not significant; accordingly, these excursions are excluded by controlling relay switches RS1 and RS2 of the detector circuit (described below with reference to FIG. 5), diodes D2 and D3 blocking pulses of the wrong polarity. The positive going excursion corresponds to the combined E.M.F's of the search coils as the vane passes the symmetrical position corresponding to the maximum rate of change of flux for each coil ($D_B$ and $D_T$ in FIG. 3 respectively). FIG. 4A ignores the presence of the magnetically operated switch such as 24 within the search coil for clarity in the diagram; the presence of this switch is, however, of practical significance, in that the process of releasing the switch produces in the search coil as EMF that adds to the voltage excursions shown at B1. It should be noted that, in use, when the machinery is decelerated to the stop position, the speed variation modifies the E.M.F. produced.

Arrival at floor level is signified by the operation of the magnetically operated switches and this promotes the application of a frication brake to the machinery and the disconnection of all power from the machinery. However, this action takes a significant, although small, time and during this time the signal in the search coils due to the physical movement of the magnetic switch blade transferring from the closed to the open conditions provides a signal to the regulator to invoke maximum braking torque.

Figure 5:
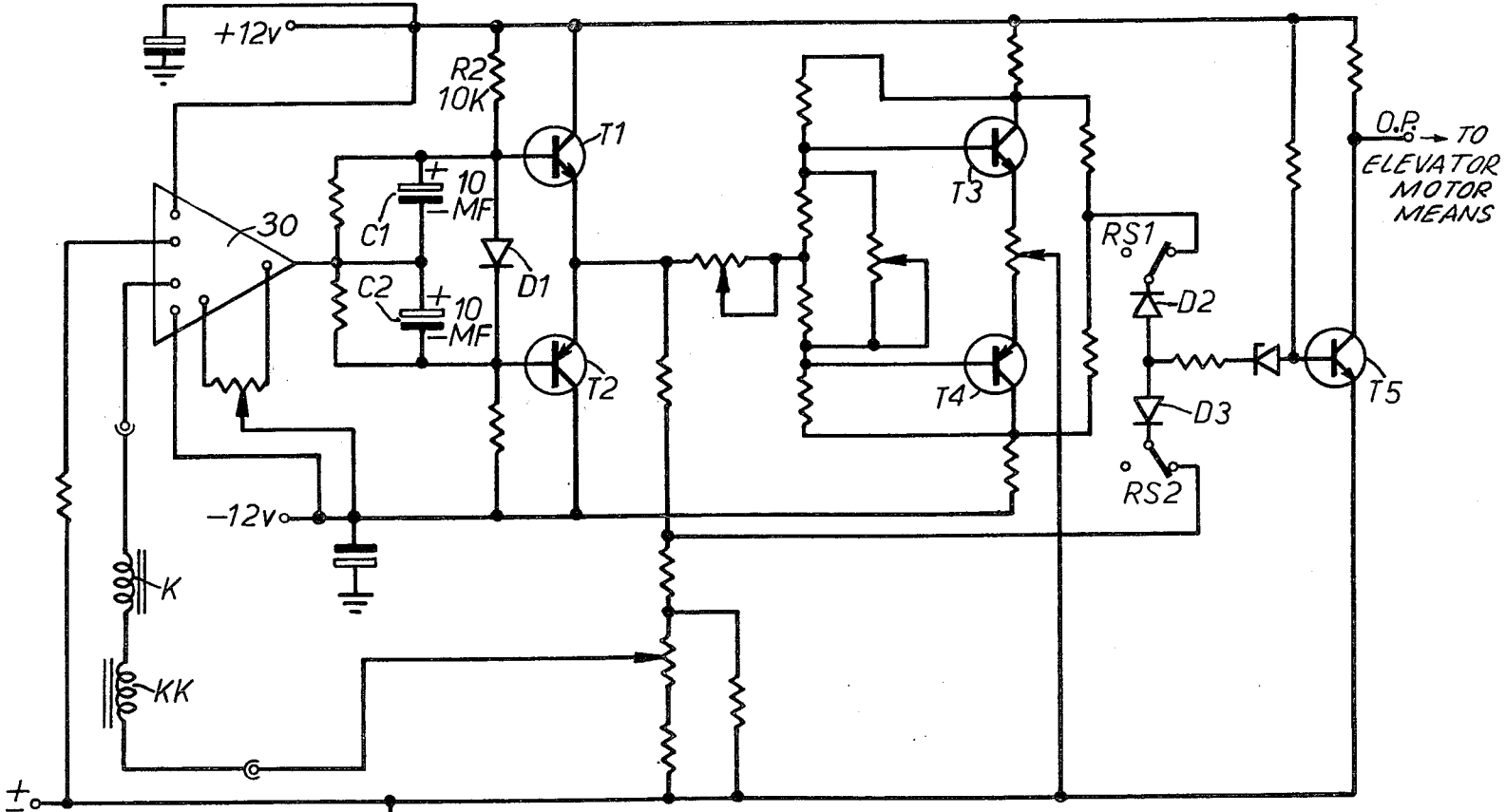
FIG. 5 is a diagram of a signal processing device in the control apparatus.

FIG. 5 shows the detector circuit connected to the search coil terminals. The counter-connected coils at K and KK are connected to an amplifier AMP which is followed by a buffer stage involving transistors T1 and T2 which feeds into an inverter stage involving transistors T3 and T4. According to lift direction, as set by relay switches RS1 or RS2, either the output from the buffer stage or the output from the inverter stage is forwarded through a buffer amplifier to a regulator (not shown) which may be a pair of thyristors and a phase angle firing control for the thyristors, the thyristors controlling the lift drive motor and being capable of reversing the thrust of the motor. The greater the output from the search coil, the greater the output from the regulator and the greater the retarding force imposed upon the machinery. Feedback of the regulator action through the machinery, and through the detector acts to maintain the output of the detector at a certain level; consequently, the speed of rotation of the drive machinery is continuously reduced as floor level is approached, in order that the rate of change of the magnetic flux should be held substantially constant; once the slope of the magnetic pattern increases as floor level is approached, the only means of satisfying this requirement is that the rate of relative movement of the search coil and the magnetic pattern should reduce as floor level is approached.

The thyristors of the regulator may be associated with a step down transformer of the double wound type allowing connection into the generator field circuit of a variable voltage lift drive system in such a way that the output from the regulator acts in opposition to and ultimately reverses the generator excitation field level that is provided by one or other of known forms of control systems that control the generator field strength in accordance with the requirements of lift running speed. By close control of the floor approach speed, it is possible to relax some of the constraints that normally operate within the elements of the generator field control system that associate with lift running speed, and this refers to the operating conditions of the lift after it has been instructed initially to decelerate from its running speed, in the process of making a floor stop.

FIG. 4A assumes ideal circumstances in which the search coils are positioned and arranged so that they each release on the point of maximum slope; in other words, in which G2 coincides with G3. However, this condition will not be regularly achieved in practice due to inevitable discrepancies that occur between, for example, different actuating vanes associated with the detecting devices. Whilst the vane lengths may be closely controlled, accurate vertical alignment of the vanes in the lift shaft is difficult to achieve. In the event that the level G2 occurs below the level G3 of maximum slope, the operation is not satisfactory since the devices must pass through the point of maximum slope before the release of the switch occurs. This means that the process of deceleration is reversed just prior to achieving the nominal stopping point, whereas it is preferred for the deceleration process to continue until the datum point is achieved.

Figure 4B:
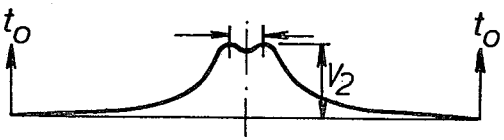

FIG. 4B represents an acceptable modification that can be adopted in order to cater for the deviations described above. In this the detectors are spaced further apart than the ends of the vane, and the switches are arranged to release before the flux falls to the level G3 of maximum slope; in other words, G2 is arranged to be greater than G3 as shown in FIG. 3. The double humped nature of the E.M.F. curve is of small consequence since the release of the switch occurs on the leading hump. The reduction of peak amplitude relative to FIG. 4A is of small consequence. It is expected that, in practice, the spacing between the humps relative to the datum point will not exceed 0.1 inch and this amounts to an acceptable small anticipation of floor level (datum point).

This invention can be used in a lift control system of the kind which is the subject of our British Patent No. 1,177,264, although the invention also has wider application.

What is claimed is:

1. Control apparatus for controlling the relative motion of first and second relatively movable members, said apparatus comprising:

a. flux responsive means attached to one of said first and second members;

b. magnetic means attached to the other of said first and second members for cooperation with said flux responsive means to change the flux therethrough on relative movement of said first and second members;

c. means responsive to the rate of change of flux through said flux responsive means to provide a control signal in accordance therewith; and d. means for reducing the relative speed of said first and second members in response to increase in said control signal, whereby to tend to maintain the rate of change of flux through said flux responsive means at a constant level.

2. Apparatus as claimed in claim 1 wherein said first member is fixed.

3. Apparatus as claimed in claim 2 wherein said second member has a preselected stopping position, said flux responsive means and said magnetic means cooperating to provide a maximum rate of change with displacement of the flux through said flux responsive means when said second member is at substantially said stop position.

4. Apparatus as claimed in claim 3 comprising means responsive to the magnitude of the flux through said flux responsive means to halt movement of said second member at said stopping position.

5. Apparatus as claimed in claim 4 wherein said flux responsive means comprises at least a first sensor device including a winding and a magnet disposed adjacent said winding for flux from said magnet to pass through said winding, and wherein said magnetic means comprises a vane of ferromagnetic material for passing between said magnet and said winding on relative movement of said first and second members to change the flux through said winding.

6. Apparatus as claimed in claim 5 wherein said means responsive to the magnitude of the flux comprises a reed switch unit forming part of said sensor device.

7. Apparatus as claimed in claim 6 wherein said flux responsive means comprises a second sensor device including a second winding and a second magnet mutually disposed in a similar way to the said winding and magnet of said first sensor device, said first and second sensor devices being spaced apart along the direction of relative movement of said second member and said vane being shaped and arranged for producing a peak rate of change with displacement of flux in both said windings when said second member is at substantially said stop position.

8. Apparatus as claimed in claim 7 wherein the rates of change with displacement of flux in said windings are in opposite senses and said windings are connected in antiphase to minimize the effect thereon of stray flux fields, said means responsive to the rate of change of flux being responsive to the sum of the voltages induced in said windings to provide said control signal.

9. Apparatus as claimed in claim 8 wherein said means for reducing the relative speed of said first and second members comprises brake means for said second member operable in response to values of said control signal exceeding a threshold value.

10. Apparatus as claimed in claim 9 comprising further brake means responsive to operation of said reed switch unit to halt movement of said second member.

11. Elevator control apparatus for decelerating an electricmotor-driven elevator car as it approaches a given floor during its vertical travel relative to the elevator shaft and for braking the car when it reaches the floor stop position, comprising a. a pair of vertically spaced flux sensing means (12, 14) adapted for connection with one of the car and shaft members, each of said sensing means including

1. a body member having a generally U-shaped crosssectional configuration defining a pair of parallel horizontally spaced arm portions (16, 18);

2. magnetic means (2) connected with one of said arms for defining a magnetic field; and

3. flux-responsive means connected with the other of said arms, said flux responsive means including a. a search coil (26); and b. magnetic brake switch means (24) operable between first and second conditions when the level of the flux detected thereby is above and below a given value, respectively;

b. a ferromagnetic vane (10) adapted for vertical connection with the other of said car and shaft components to extend between the arms of said body members during vertical movement of the car and thereby vary the flux transmitted to said search coils and said brake means, said sensing means being vertically spaced a distance at least as great as the vertical dimension of the vane;

c. electrical signal generating means (30) for connecting the search coils of said sensing means in opposition and for supplying to the elevator motor an electric signal which is a function of the rate of change of the variation in magnetic flux produced by the passage of said vane between the arms of said sensing means, thereby to decelerate the car as it approaches the floor stop position; and d. brake means (28) operable by said brake switch means for braking the car when it is in the desired floor stop position.

12. Apparatus as defined in claim 11, wherein said signal generating means further includes amplifier means (30) having an input terminal connected with said search coils, and an output terminal; a buffer stage ($T_1$, $T_2$) having an input terminal connected with the amplifier output terminal and an output terminal; an inverter stage ($T_3$, $T_4$) having an input terminal connected with the buffer stage output terminal and an output termina; an output stage ($T_5$) having input and output terminals; and switch means (RS1, RS2) for alternately connecting the input terminal of said output stage with the output terminals of said buffer and inverter stages, respectively.

* * * * *